US010315898B2

(12) United States Patent
Azad et al.

(10) Patent No.: US 10,315,898 B2
(45) Date of Patent: Jun. 11, 2019

(54) LIFTER BASED TRAVERSAL OF A ROBOT

(71) Applicant: THE HI-TECH ROBOTIC SYSTEMZ LTD, Gurugram, Haryana (IN)

(72) Inventors: Fahad Munawar Azad, Haryana (IN); Anuj Kapuria, Haryana (IN)

(73) Assignee: THE HI-TECH ROBOTIC SYSTEMZ LTD., Gurugram (IN)

( * ) Notice: Subject to any disclaimer, the term of this patent is extended or adjusted under 35 U.S.C. 154(b) by 211 days.

(21) Appl. No.: 15/590,054

(22) Filed: May 9, 2017

(65) Prior Publication Data

US 2017/0327359 A1 Nov. 16, 2017

(30) Foreign Application Priority Data

May 11, 2016 (IN) ..... 201611016505

(51) Int. Cl.
*B66F 9/06* (2006.01)
*B66F 9/07* (2006.01)

(52) U.S. Cl.
CPC ..... *B66F 9/072* (2013.01); *B66F 9/063* (2013.01)

(58) Field of Classification Search
CPC ..... B66F 9/063; B66F 9/072
See application file for complete search history.

(56) References Cited

U.S. PATENT DOCUMENTS

2007/0065258 A1* 3/2007 Benedict ..... B63B 25/22 414/266
2016/0375723 A1* 12/2016 Jochim ..... B60B 19/003 280/30
2016/0375814 A1* 12/2016 Jochim ..... B62D 57/04 414/547

* cited by examiner

*Primary Examiner* — Dale Moyer
(74) *Attorney, Agent, or Firm* — Law Offices of Steven W. Weinrieb

(57) ABSTRACT

A lifter system based traversal mechanism for a robot includes detection of the robot at a predetermined distance from a movable platform. The movable platform is part of the lifter system. Teeth orientation of cog wheels of the robot are changed to match teeth orientation of teeth of a fixed teeth structure of the movable platform. The movable platform is moved in to a predetermined proximity of the robot so that teeth are engaged. The movable platform takes the robot from a first position to a second position. On reaching the second position the robot is disengaged from the movable platform.

10 Claims, 13 Drawing Sheets

LIFTER BASED TRAVERSAL OF A ROBOT

CROSS REFERENCES TO RELATED APPLICATIONS

This application claims priority of Indian Patent Application No. 201611016505 filed on May 11, 2016, the entire content of which is hereby incorporated by reference.

TECHNICAL FIELD

The present invention, in general related to a traversing mechanism for a robot. In particular, the present invention relates to a lifter based traversal mechanism for an autonomous robot.

BACKGROUND OF THE INVENTION

Various types of robots are known in the art which are employed for a variety of tasks in differing environments. Robots may be autonomous, semi-autonomous, or manually controlled. One kind of robots are robotic vehicles which traverse with the wheels and carry a payload.

Robotic vehicles may be deployed for a number of tasks in different environments. Robotic vehicles may be deployed in warehouses to carry items, in hostile environments for specific missions, or for surveillance purposes.

Specifically, with advances in warehouses automations more and more robotic vehicles are being deployed for moving items in a warehouse or industrial unit from one place to another.

Movement of robotic vehicles in closed environments such as warehouses or industrial units have attracted much attention in recent times due to rapid increase in e-commerce businesses which need efficient and fast mechanisms to cater to ever growing consumer demands for fast delivery of orders.

However, traversing mechanisms for robotic vehicles in state of the art suffers from several limitations. First, some robotic vehicles are capable of moving on a planar surface, such as a floor of a warehouse. These robotic vehicles lack mechanism for climbing any elevation. Other robotic vehicles are capable of climbing elevation but lack mechanisms to carry any payload with them.

Some existing systems have tried to overcome above limitations by deploying two or more sets of robotic vehicles in the warehouse. First set of robotic vehicles navigate on the floor and a second set of robotic vehicles move up and down along vertical rails which connects levels/floors in the warehouse. The first set of robotic vehicles move the material/item/package ("payload") to the vertical rails. The payload is manually transferred to the second set of robotic vehicles which takes the payload to a desired level or floor. As is evident from above, this is a cumbersome and time intensive process which also requires manual intervention.

Further, earlier mechanisms or structures provided for climbing an elevation by a robotic vehicle suffered from several limitations such as slippage of wheels of the robotic vehicle on the traversal track, incorrect angle of approach between teethed wheels of the robotic vehicle and a grooved/teethed traversal track.

The present disclosure provides traversal systems and methods for robotic vehicles to overcome above and other limitations of the existing systems.

OBJECTS OF THE INVENTION

It is an object of the present invention to provide a lifter system for a robotic vehicle.

It is another object of the present invention to provide correct angle of approach between a robotic vehicle and a movable platform.

It is yet another object of the present invention to provide a lifter system to facilitate efficient and cost effective traversal of a robotic vehicle throughout a warehouse including floor and elevated locations such as depositories.

SUMMARY

The following presents a simplified summary of the subject matter in order to provide a basic understanding of some aspects of subject matter embodiments. This summary is not an extensive overview of the subject matter. It is not intended to identify key/critical elements of the embodiments or to delineate the scope of the subject matter. Its sole purpose is to present some concepts of the subject matter in a simplified form as a prelude to the more detailed description that is presented later.

In an embodiment, the present invention discloses a method of traversing for a robot. The method includes detecting arrival of the robot at a first position. The first position may be at a predetermined distance from a movable platform of a lifter system. The method includes determining an initial teeth orientation of at least one cog wheel of the robot with respect to a fixed teeth structure of the movable platform. The method further includes changing the initial teeth orientation of the at least one cog wheel to complement the teeth orientation of the fixed teeth structure. The method further includes engaging the teeth of the at least one cog wheel with the fixed teeth structure by moving the movable platform to a predetermined proximity of the robot. The method further includes moving the engaged robot with the movable platform by the lifter system to a destination position.

In another embodiment, the present invention discloses a system for traversing of an autonomous robot from a first position to a second position. The system includes a wheel based autonomous robot comprising a plurality of floor wheels and a plurality of cog wheels. The plurality of floor wheels are engaged when the autonomous robot traverses a planar floor surface. The system further includes a lifter system that includes a movable platform. The movable platform may include a fixed teeth structure complementing teeth of the plurality of cog wheels. The system further includes a central processing system. The central processing system is configured to track the autonomous robot, control the lifter system based on a position of the autonomous robot, determine a teeth orientation of the plurality of cog wheels of the autonomous robot, and change the teeth orientation of the plurality of cog wheels based on a distance between the movable platform and the autonomous robot.

These and other objects, embodiments and advantages of the present disclosure will become readily apparent to those skilled in the art from the following detailed description of the embodiments having reference to the attached figures, the disclosure not being limited to any particular embodiments disclosed.

BRIEF DESCRIPTION OF THE DRAWINGS

For a better understanding of the embodiments of the systems and methods described herein, and to show more clearly how they may be carried into effect, reference will now be made, by way of example, to the accompanying drawings, wherein like reference numerals represent like elements/components throughout and wherein.

DETAILED DESCRIPTION OF THE INVENTION

Figure 1:
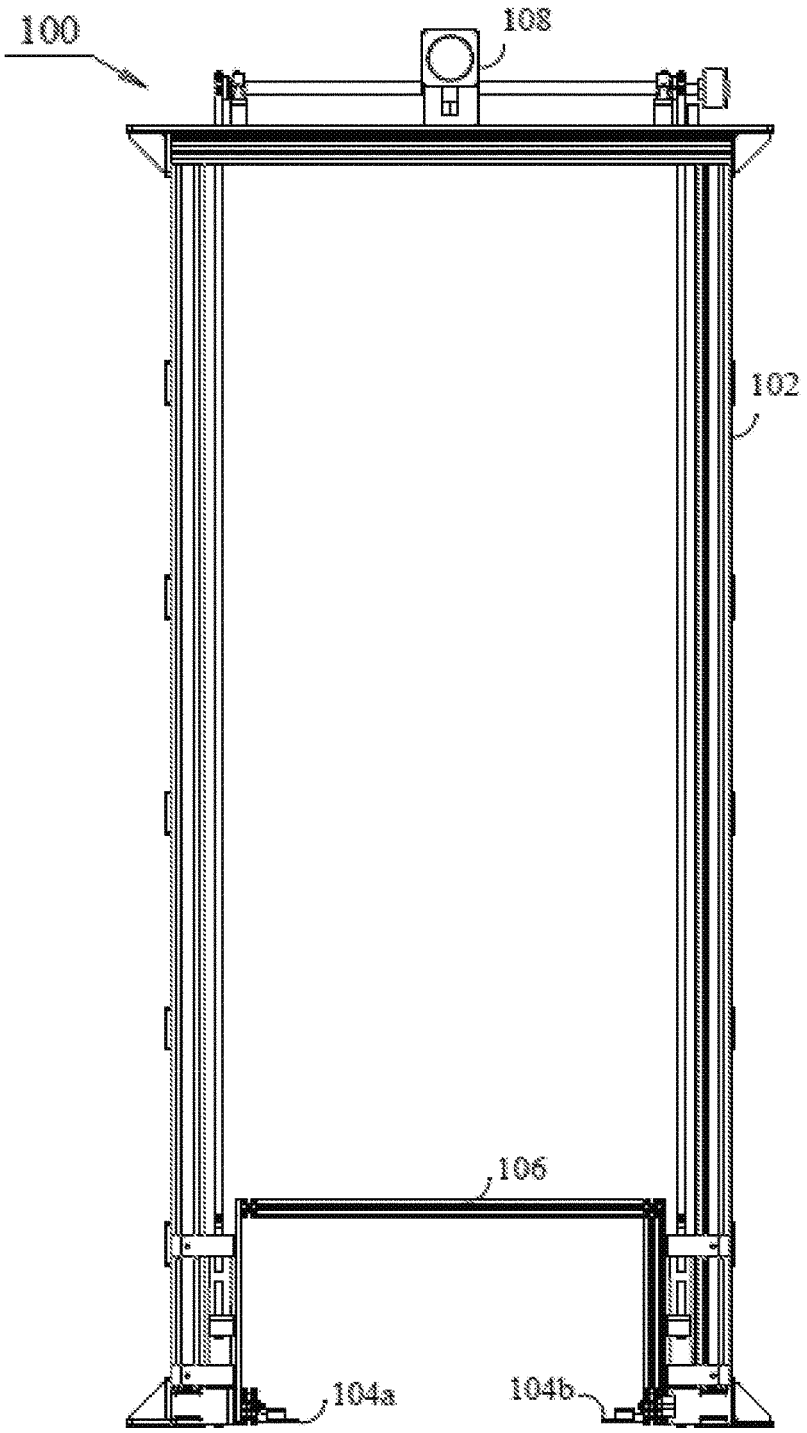
FIG. 1 illustrates a front view of a lifter system, in accordance with an embodiment of the present invention.

Exemplary embodiments now will be described with reference to the accompanying drawings. The disclosure may, however, be embodied in many different forms and should not be construed as limited to the embodiments set forth herein; rather, these embodiments are provided so that this disclosure will be thorough and complete, and will fully convey its scope to those skilled in the art. The terminology used in the detailed description of the particular exemplary embodiments illustrated in the accompanying drawings is not intended to be limiting. In the drawings, like numbers refer to like elements.

The specification may refer to "an", "one" or "some" embodiment(s) in several locations. This does not necessarily imply that each such reference is to the same embodiment(s), or that the feature only applies to a single embodiment. Single features of different embodiments may also be combined to provide other embodiments.

As used herein, the singular forms "a", "an" and "the" are intended to include the plural forms as well, unless expressly stated otherwise. It will be further understood that the terms "includes", "comprises", "including" and/or "comprising" when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include operatively connected or coupled. As used herein, the term "and/or" includes any and all combinations and arrangements of one or more of the associated listed items.

Unless otherwise defined, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 illustrates a front view of a lifter system 100, in accordance with an embodiment of the present invention. The lifter system 100 includes a frame 102, teethed structure 104, a movable platform 106, and a moving means 108.

The frame 102 may be rectangular door like structure made of a hard material such as steel, metal or concrete. Various coupling mechanism may be provided in the frame 102 to couple various components or systems to the frame 102. The coupling mechanisms may include, but not limited to, nut and bolts, screws, and adhesives.

The movable platform 106 may include a base that includes teethed structure 104. The teethed structure may include two linear members 104*a* and 104*b* placed parallel to each other at a predetermined distance and coupled to a frame of the movable platform 106. The predetermined distance between the linear members may be based on a width of a robot that is to be lifted by the movable platform 106. Further, length of the linear members 104*a* and 104*b* may be based on an overall length of the robot or distance between front and rear cog wheels.

The linear members 104 may be made of a hard material including, but not limited to, a metal, hardened plastic, or polymer. The linear member 104 may also be formed by imposing hard plastic or rubber on a metallic base. The linear member 104 may have teeth cut out at least on part of its upper side. The teeth of the linear member 104 may be used to engage the teeth of cog wheels of the robot. In one embodiment, the linear members 101 as shown in FIG. 1 are placed perpendicular to the plane of the paper.

The movable platform 106 is movable vertically up and down along the height of the frame 102 by the moving means 108.

Figure 2:
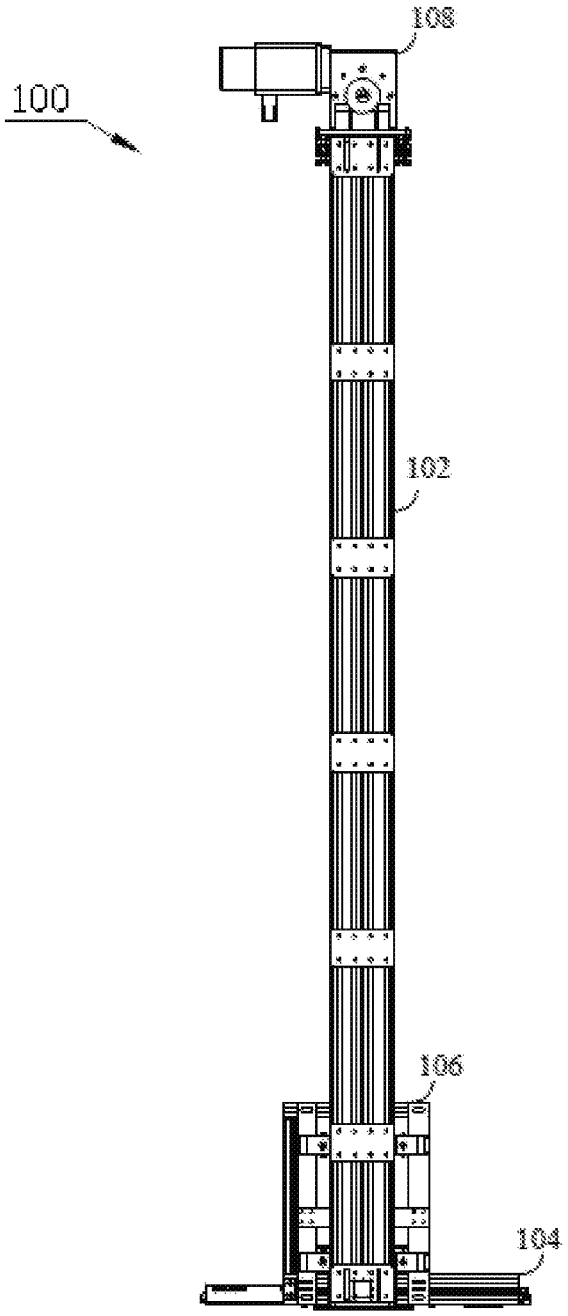
FIG. 2 illustrates a side view of the lifter system, according to an embodiment of the present invention.

The moving means 108 may include any means including, but not limited to, an electric motor mechanism, a magnetic effect based mechanism, and gravitational force based mechanism. In the electric motor mechanism there may be provided a motor, a pulley, and ropes. The ropes may be made of plastic or metal or an alloy, which may move on the pulley with the mechanical force provided by the motor to move the platform 106 up and down. FIG. 2 illustrates a side view of the lifter system 100 of FIG. 1 according to an embodiment of the present invention.

Figure 3:
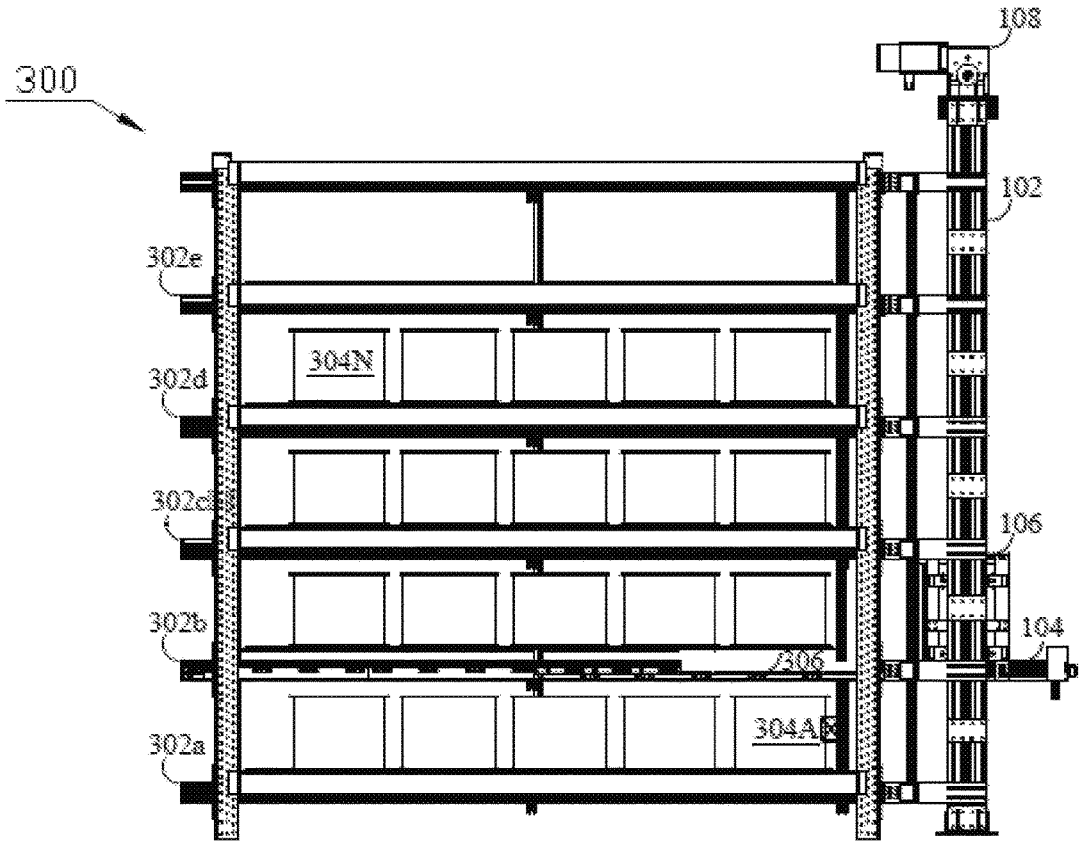
FIG. 3 illustrates the lifter system coupled to a depository, according to an embodiment of the present invention.

FIG. 3 illustrates the lifter system 100 coupled to a depository 300, according to an embodiment of the present invention. The depository 300 may include a plurality of levels (302*a*, 302*b*, 302*c*, 302*d*, and 302*e*) placed at different heights from the ground level or floor. The levels 302 may include bins 304A-304N. The bins 304 may be used to store one or more items. The one or more items may include any merchandise required to be stored in the depository 300. The merchandise may be packed in containers, which can then be placed in the bins 304. In one embodiment, the levels 302 are placed at regular height intervals from the ground level or floor. In one embodiment, each of the levels 304 may include equal number of bins 304.

In FIG. 3, at level 302*b*, a section of the depository 300 is cut out to show teethed tracks 306 which are used by the robot to move on the level 302*b*. The teethed tracks 306 are used by the robot to move among the bins 304 placed at level 302*b*. Similar, teethed tracks may be provided at each level 302*a-e* of the depository 300.

Figure 4:
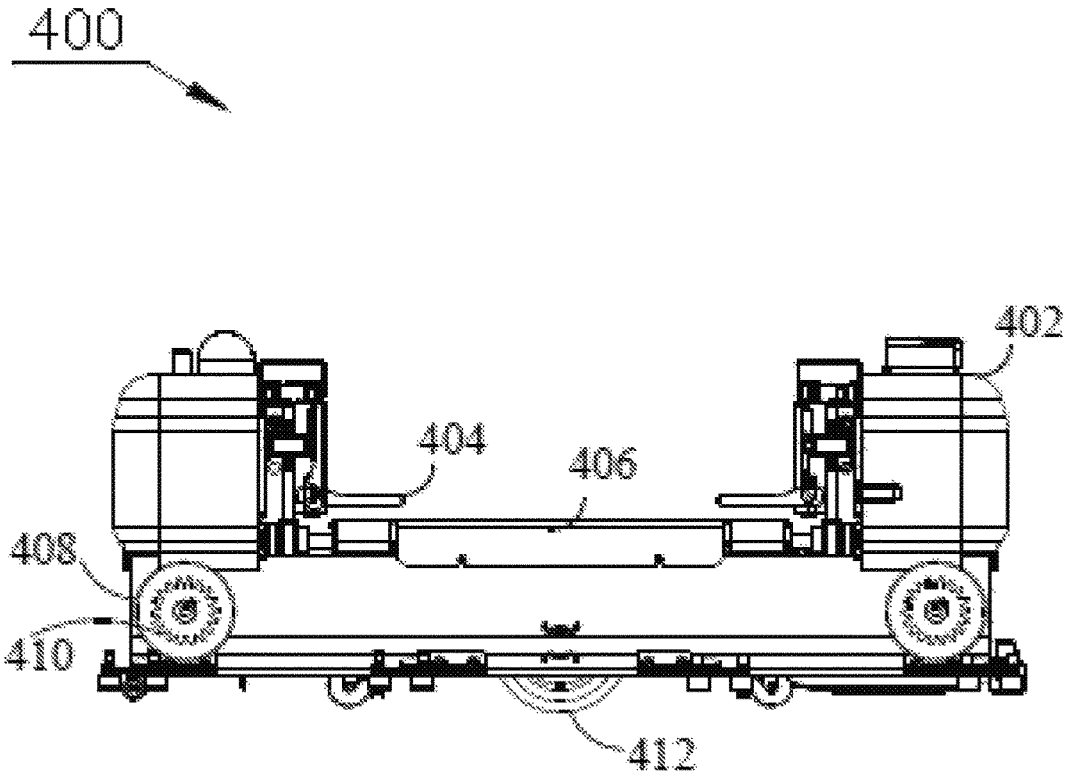
FIG. 4 illustrates a robot that traverses on floor and depositories using the lifter system, according to an embodiment of the present invention.

FIG. 4 illustrates a robot 400 that traverses on floor and depository 300 using the lifter system 100, according to an embodiment of the present invention. The robot may include a frame 402 that may house various components or devices of the robot 400. The robot may further include stoppers 404 to hold a payload on the platform 406.

The robot 400 includes a drive assembly to allow the robot 400 to move in a horizontal or vertical direction; the platform 406 to carry a plurality of items; and a control device to control the movement of said drive assembly and the platform 406. The drive assembly includes two sets of drive wheels and a drive unit to control the movement of the drive wheels. The first set of drive wheels consists of a pair of floor drive wheels 412, which are responsible for motion on the floor; and a second set of drive wheels consists of four cog wheels 408, which are responsible for the motion on the grooved tracks of depository 300.

When the robot 400 is navigating on the floor, both the floor drive wheels 412 are in contact with the floor and all four cog wheels 408 are not in contact of the floor. Whereas, when the robot 400 is navigating on the depository 300, then only the cog wheels 408 are in contact with the grooved tracks 306 of the depository 300.

The robot 400 may include a control device (not shown). The control device includes a processor; a memory to store control instructions and sensor data; a network interface wirelessly connected with other devices to communicate, collect and update data; an environment sensing and data acquisition unit to obtain environment data and sensor data; a navigation control unit to calculate the shortest path to reach intermediate goal positions based on target positions and sensor data and sends appropriate velocity to a drive control unit; and a drive motor control unit navigates the drive wheels for floor navigation or depository 300 navigations.

In one embodiment, the robot 400 is an autonomous robot. In this embodiment, the autonomous robot 400 may include a processing unit coupled to a memory, the processing unit executing instructions stored in the memory to communicate with a control unit, the control unit configured to control various functions and configurations of the autonomous robot. The autonomous robot 400 may further include a plurality of sensors to sense external environmental conditions and internal configuration of the autonomous robot 400. The autonomous robot 400 may further include a transceiver configured to exchange data signals with the lifter system 100 and the central processing system 1202 (FIG. 12) based on the external environmental conditions and the internal configuration.

Figure 5:
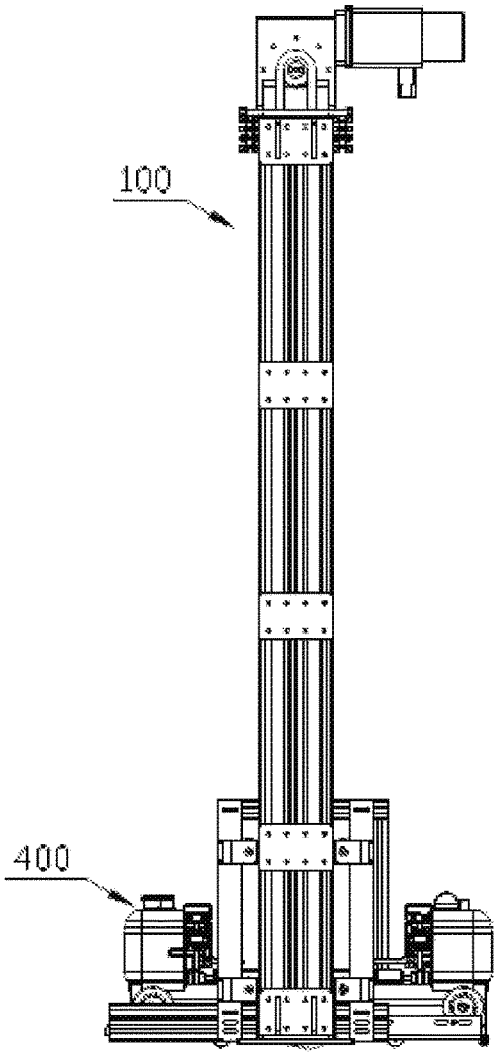
FIG. 5 illustrates the robot at a base level of the lifter system, according to an embodiment of the present invention.

FIG. 5 illustrates the robot 400 at a base level of the lifter system 100, according to an embodiment of the present invention.

Figure 6:
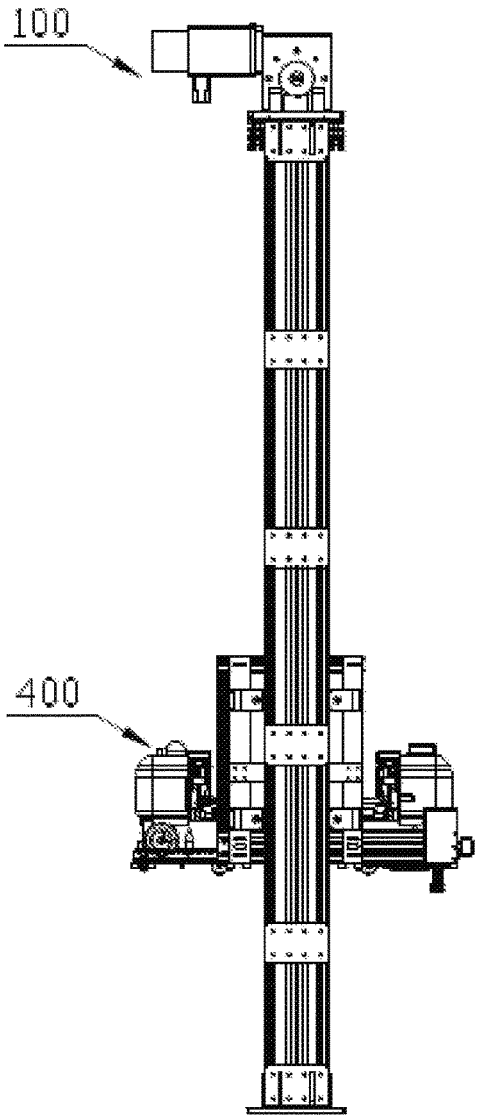
FIG. 6 illustrates the robot at a depository level of the lifter system, according to an embodiment of the present invention.

FIG. 6 illustrates the robot 400 at a level 302 of the lifter system 100, according to an embodiment of the present invention.

Figure 7:
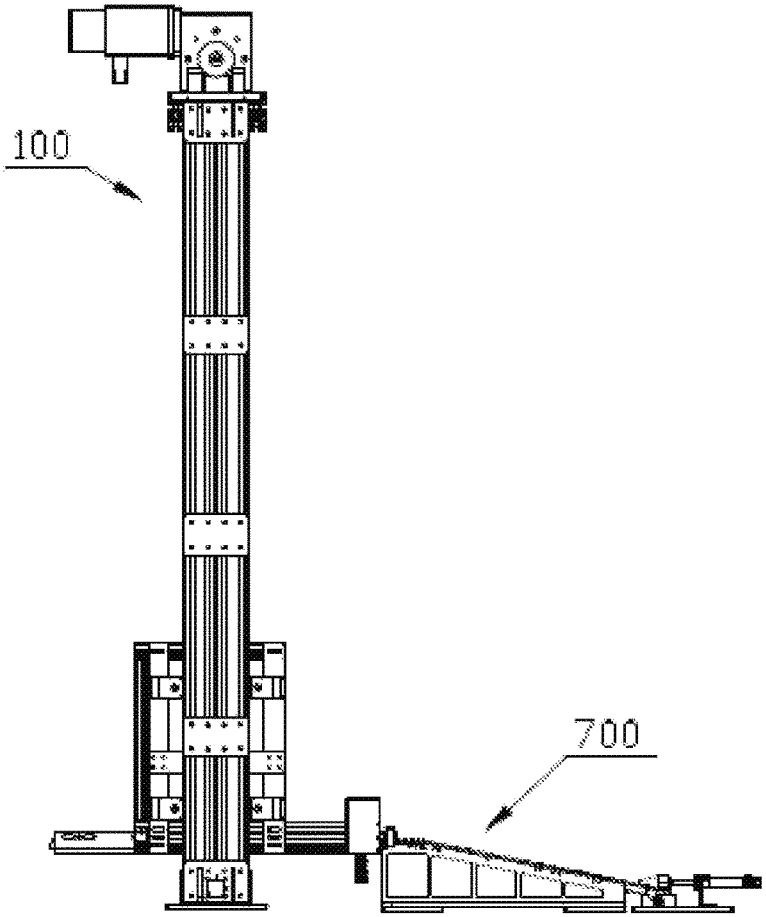
FIG. 7 illustrates a climb structure that may be used with the lifter system, according to an embodiment of the present invention.

FIG. 7 illustrates a climb structure 700 that may be used with the lifter system 100, according to an embodiment of the present invention. The climb structure 700 may include a climber, a horizontal structure, and a ramp coupled on to a base plate. The horizontal structure and the ramp are collinearly situated on opposite sides of the climber. The horizontal structure, the climber, and the ramp may be placed on the base plate in a linear fashion at predetermined distances from one another. The predetermined distances may be based on one or parameters, for example, but not including, height of the ramp, length of the climber, and a height and shape of the horizontal structure.

The base plate may be a planar structure made of hard material such as metal or concrete. The base plate may be in shape of a cuboid having a predetermined height from the ground. The horizontal structure, the climber, and the ramp may be coupled on the base plate via a coupling mechanism. The coupling mechanism may include, but not limited to bolts, screws, and/or adhesive.

In an alternative embodiment, the climb structure 700 may not include the base plate. In this embodiment, the horizontal structure, the climber, and the ramp may be coupled directly on the ground or floor of a warehouse or any facility where the climb structure 700 is deployed.

The horizontal structure may include two parallel rail guides. The rail guides may be of same height and configuration and placed at a predetermined distance from each other. The rail guides may be used for movement of a robotic vehicle thereon. The horizontal structure may be made of a hard material. The hard material may be metal or hardened plastic.

The ramp may include two parallel slanted grooved tracks placed at a predetermined distance from each other. The predetermined distance between the parallel tracks may be same as the predetermined distance between the rails guide of the horizontal structure, both of which predetermined distances may be based a width of the robot 400.

The climber is coupled in place on to the base plate between the horizontal structure and the ramp. The climber may include two identical climbers placed parallel to one another at a predetermined distance from each other. The predetermined distance between the two climbers may be same as the predetermined distance between the parallel tracks of the ramp and the predetermined distance between the rails guide of the horizontal structure, all of which predetermined distances may be based a width of a robotic vehicle.

The two climbers may be operated independently or through a common mechanism. When operated independently, each of the climbers may include a separate spring element. When operated together, the common mechanism may be a single spring element coupled to both of the climbers. In this case, both of the climbers may move about their respective axes simultaneously.

The climber includes a linear member. The linear member may have a free end and a fixed end. The linear member have teeth aligned along one side. The fixed end is coupled tangentially to a spring element. The spring element may provide a restoring spring force to the linear member and hold the linear member in position. The linear member is rotatable about an axis passing through the point of attachment or coupling of the linear member and the spring element. The climber is capable of providing a variable angle of elevation.

In another embodiment, the climber includes a linear member coupled to a wheel structure. The linear member may be coupled to the wheel structure in a tangential fashion. The linear member may have a free end and a fixed end. The fixed end is coupled to the wheel structure. The wheel structure may provide a restoring spring force to the linear member and hold the linear member in position. The free end moves along an arc when the fixed end rotates through an angle about an axis passing through the point of attachment or coupling of the fixed end and the wheel structure.

In an embodiment, the climber is capable of undergoing only rotational motion and that too only through a predetermined range of angles about an axis passing through the point. The predetermined range may be between zero degrees and ninety degrees.

In an embodiment, the spring element holds the linear member in an initial position at a predetermined angle of elevation to the horizontal. The predetermined angle of elevation may be based at least on one of a size of teeth of the linear member and a size of teeth of wheels of the robot 400. The predetermined angle of elevation of the linear member in the initial position may be greater than an angle of elevation of the ramp. In an embodiment, the predetermined angle of elevation of the linear member in the initial position may be between zero degrees and ninety degrees.

In an embodiment, the linear member of the climber may be made of a hard material. The hard material may be a metal or hardened plastic. In one embodiment, the linear member may be made of a metallic base and hardened plastic imposed thereon. Further, grooves/teeth may be etched/cut on the linear member.

In an embodiment, teeth/grooves on the linear member of the climber, teeth on the ramp, teeth on the linear members 104, and teeth on the track 306 of the depository 300 may be of same shape and dimension.

Figure 8:
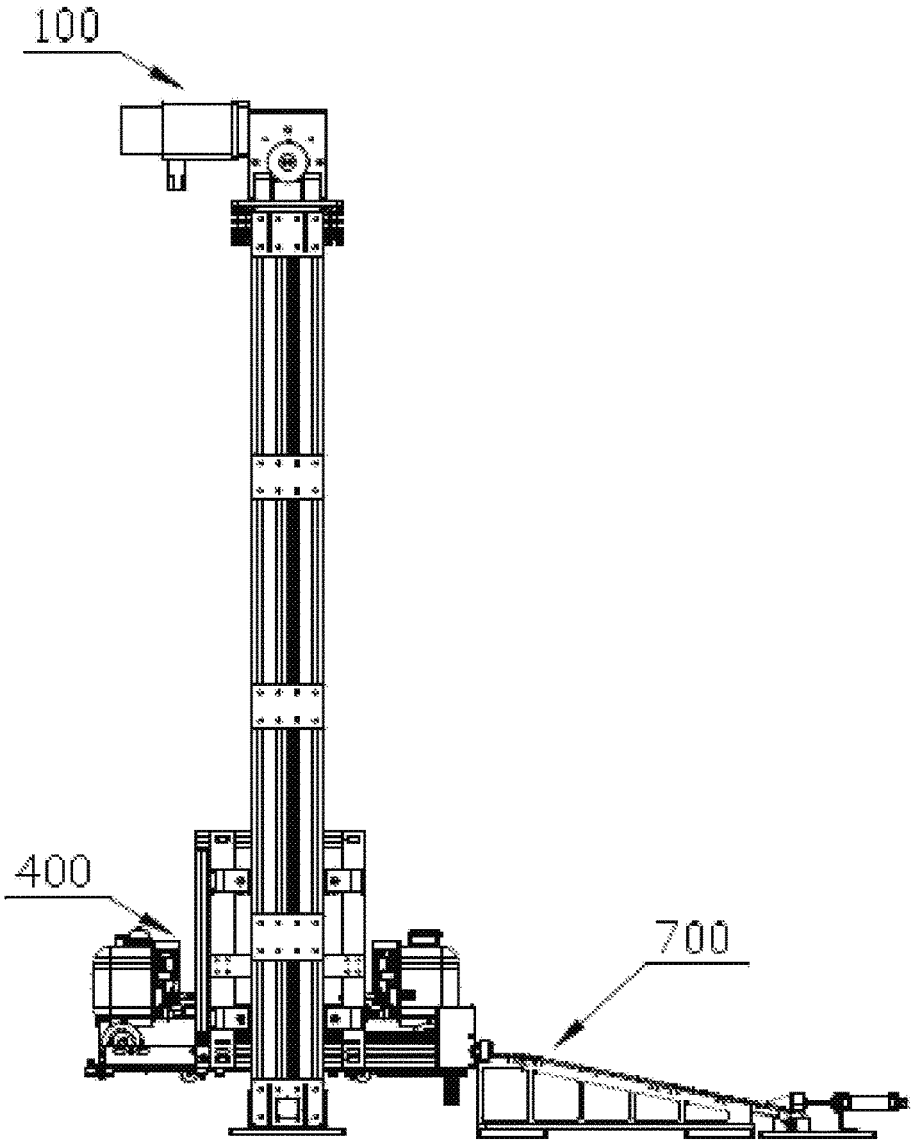
FIG. 8 illustrates a ramp that may be used with the lifter system to move the robot from the floor to the base level of the lifter system, according to an embodiment of the present invention.
Figure 9:
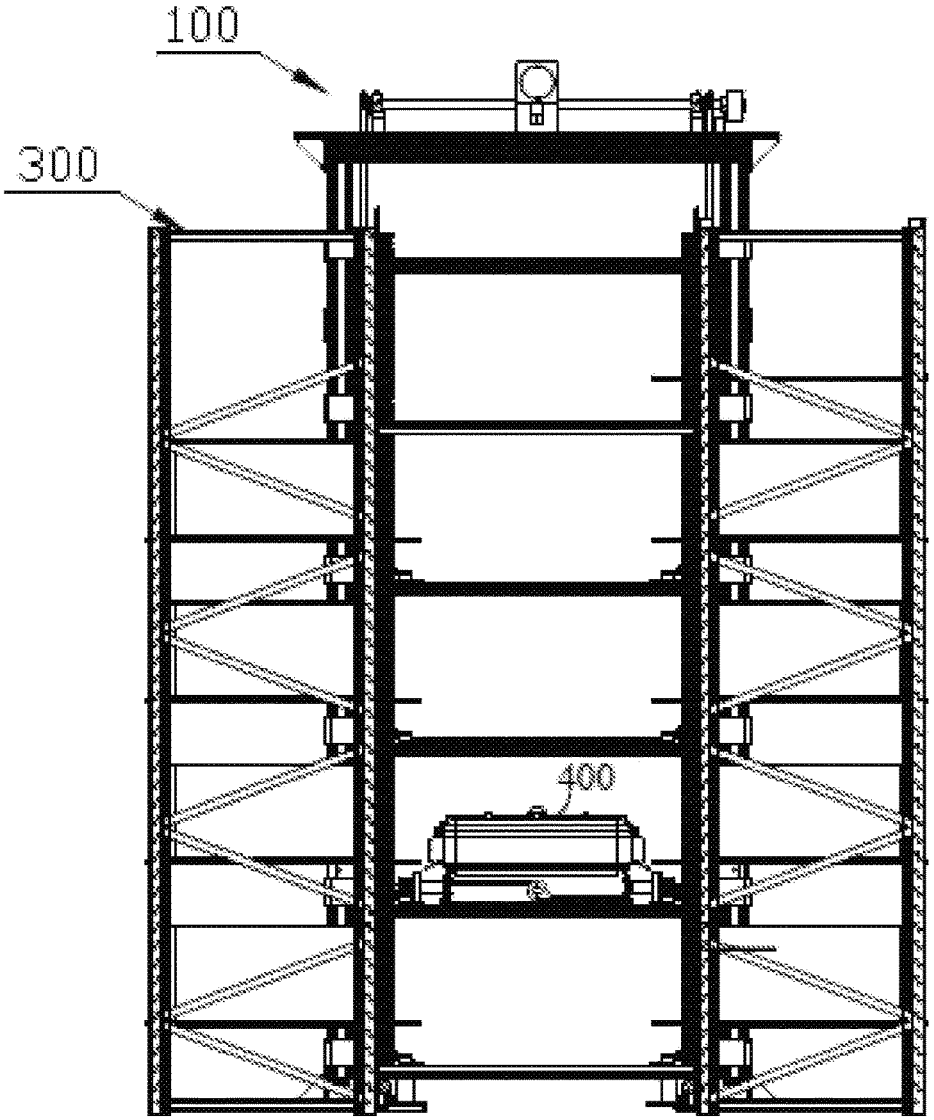
FIG. 9 illustrates front view the robot at a first level of depository, according to an embodiment of the present invention.
Figure 10:
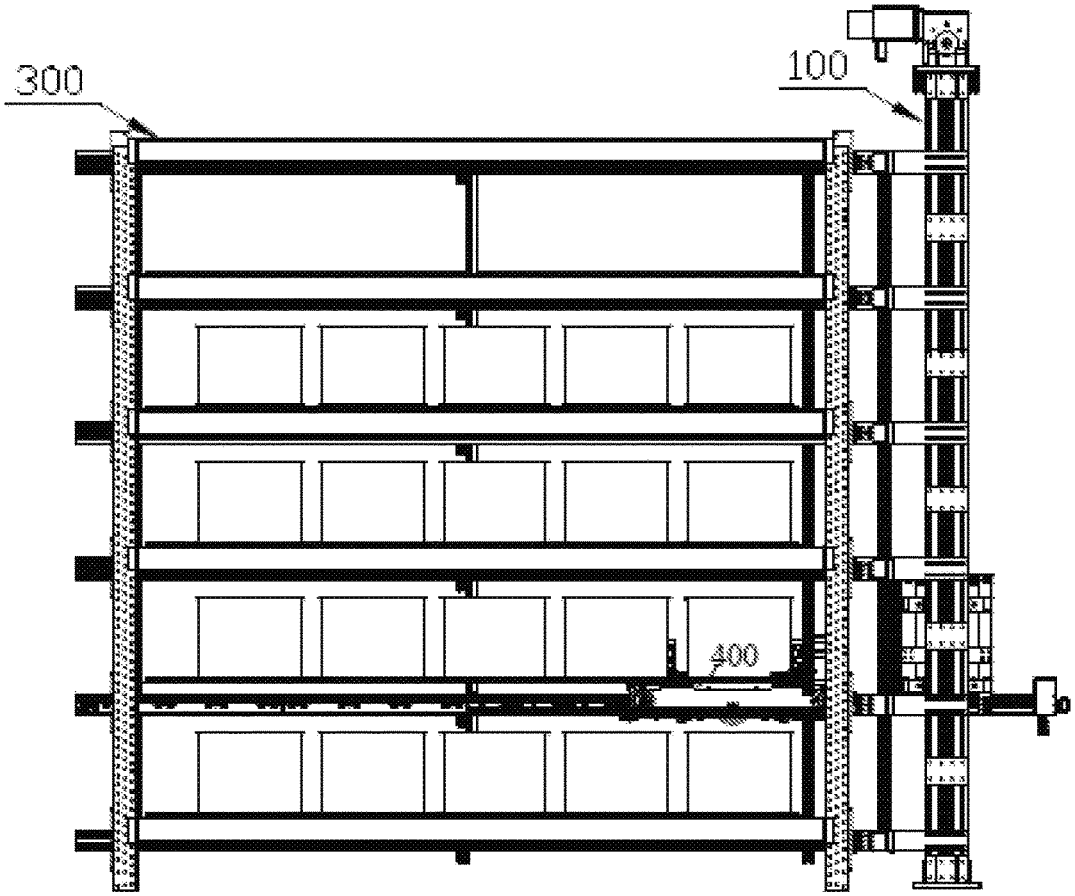
FIG. 10 illustrates side view the robot at a first level of depository, according to an embodiment of the present invention.

FIG. 8 illustrates a climb structure 700 that may be used with the lifter system 100 to move the robot 400 from the floor to the base level of the lifter system 100, according to an embodiment of the present invention. FIG. 9 illustrates front view the robot 400 at a first level of depository 300, according to an embodiment of the present invention. FIG. 10 illustrates a side view the robot 400 at a first level of depository 300, according to an embodiment of the present invention.

Figures 11A, 11B:
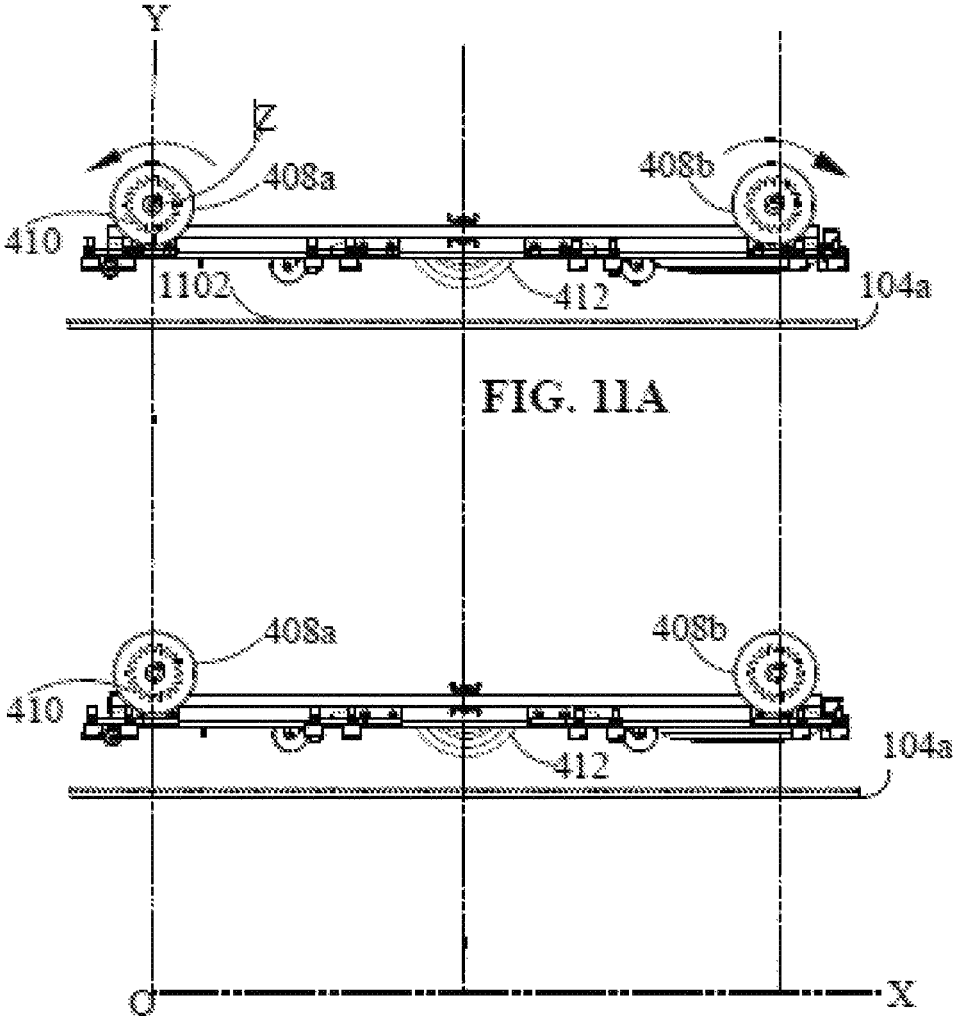
FIG. 11A illustrates first orientation of the cog wheels of the robot, according to an embodiment of the present invention.
FIG. 11B illustrates second orientation of the cog wheels of the robot, according to an embodiment of the present invention.

FIG. 11A illustrates a first orientation of the cog wheels 408 of the robot 400, according to an embodiment of the present invention. The orientation of the teeth 410 of the pair of front cog wheels 408*a* may be different from the orientation of the teeth 410 of the pair of rear cog wheels 408*b*. In one embodiment, the first orientation may be an undesired orientation. In the undesired orientation, at least part of the protruded portions of the teeth 410 of the cog wheels 408 may be directly vertically above protruded portions of the teeth 1102 of the linear member 104*a* of the fixed teeth structure 104. Further, in the undesired orientation, at least part of the depressed portions of the teeth 410 of the cog wheels 408 may be directly vertically depressed portions of the teeth 1102 of the linear member 104*a* of the fixed teeth structure 104.

FIG. 11B illustrates second orientation of the cog wheels 408 of the robot 400, according to an embodiment of the present invention. The second orientation may be a desired orientation. In the desired orientation, entire protruded portions of the teeth 410 of the cog wheels 408 may be directly vertically above the depressed portions of the teeth 1102 of the linear member 104*a* of the fixed teeth structure 104.

Further in FIG. 11A and FIG. 11B, position or location of the cog wheels 408, floor wheels 412, or the robot 400 as a whole may be referenced with respect to an orthogonal coordinate system XY with origin at point O. In this coordinate system, the cog wheels 408 may be rotated about an axis Z that is perpendicular to the plane XOY. The cog wheels 408 may be brought from an undesired orientation to the desired orientation by rotating by a desired angle either in clockwise or anticlockwise direction as the case may be. It would be understood by a person skilled in the art, that any other coordinate system may be utilized to determine and track positions of cog wheels 408, floor wheels 412, or the robot 400 as a whole.

Figure 12:
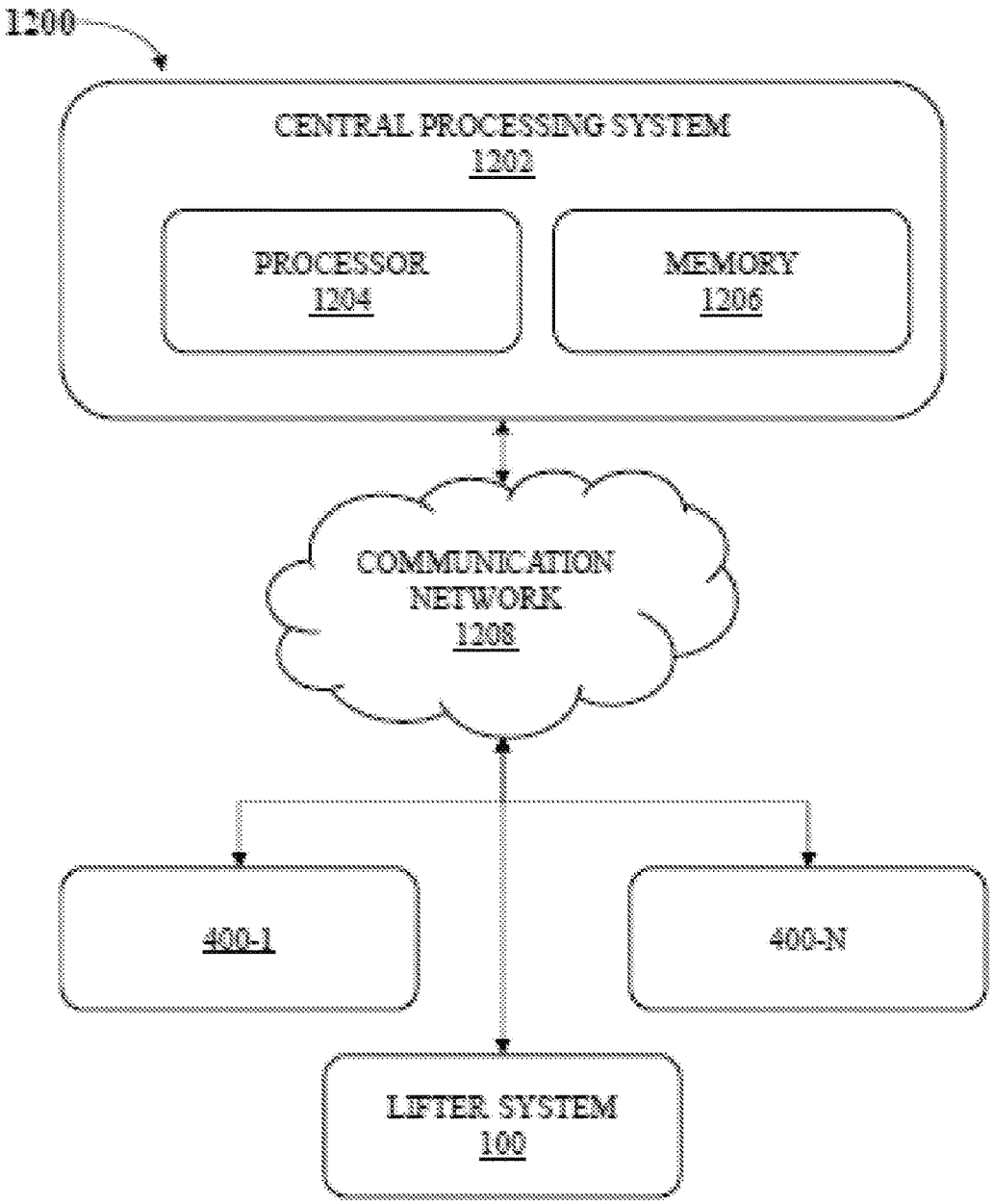
FIG. 12 illustrates a communication system for traversing mechanism of the robot, according to an embodiment of the present invention.

FIG. 12 illustrates a communication system 1200 for traversing mechanism of the robot 400, according to an embodiment of the present invention. The system 1200 includes a central processing system 1202 communicatively coupled to the lifter system 100 and a plurality of robots 400-1 to 400-N via a communication network 1208. The system 1200 may be used for traversing of the robots 400 from a first position to a second position.

The robots 400 may be deployed in a closed environment, which are responsible for deposition, and/or retrieval of a plurality of items by performing mechanical non-guided navigation on the floor i.e. horizontally in two dimensions (x-axis, y-axis) and mechanical guided navigation on both horizontal axis (x, y axis) and vertical axis (z axis). Thus, the system 1200 provides full freedom to robotic vehicles to navigate in three dimensions. The system 1200 may be deployed in a number of environments and for a number of purposes including, but not limited to warehouse management and airport luggage management.

The central processing system 1202 may include a processor 1204 communicatively coupled to a memory 1206. The processor 1204 may communicate with the memory 1206 to store, update or retrieve data or instructions to carry out various functions. In one embodiment, the instructions may be pre-stored or dynamically generated based on an interaction among the central processing system 1202, the lifter system 100, and the autonomous robot 400.

The central processing system 1202 may wirelessly controls the navigation of the robots 400. The central processing system 1202 may keep track of current position of the robots 400. The central processing system 1202 assigns the final and intermediate target locations to each of the robots 400, which can be on the floor or in the depository 300. After getting the final and intermediate target points, the robots 400 plan the shortest path to reach to the final and intermediate target positions, wherein they perform navigation for movement on the floor and in the depository 300.

In one embodiment, the wireless communication between the central processing system 1202 and the robots 400 is a Wi-Fi enabled communication. Moreover, the robots 400 can communicate with each other via central processing system 1202 or directly via the communication network 1208, to obtain health status updates and peer positional update to prevent any collision between the robots 400. In one embodiment, the communication messages may include battery status and positional updates. This also allows achieving recovery behaviors in case of any failure of any of the robots 400.

In an embodiment, the robot 400 is an autonomous robot. The autonomous robot 400 may be wheel based. The autonomous robot 400 may include a plurality of floor wheels 412 and a plurality of cog wheels 408. The plurality of floor wheels 412 are engaged when the autonomous robot 400 traverses a planar floor surface. The lifter system 100 may include the movable platform 106. The movable platform 106 may include a fixed teeth structure 104 complementing teeth 410 of the plurality of cog wheels 408. The central processing system 1202 may be configured to track the autonomous robot 400. The central processing system 1202 may be configured to control the lifter system 100 based on a position of the autonomous robot 400. The central processing system 1202 may be further configured to determine orientation of the teeth 410 of the plurality of cog wheels 408 of the autonomous robot 400 (FIG. 11 A).

The central processing system 100 may instruct the robot 400 to change the orientation of the teeth 410 (FIG. 11B) of the plurality of cog wheels 408 based on a distance between the movable platform 106 and the robot 400.

In one embodiment, a control unit of the autonomous robot 400 may be configured to disengage the plurality of floor wheels 412, determine a relative orientation of teeth of the plurality of cog wheels 408, and change the relative orientation to a desired relative orientation based on at least a distance between the movable platform 106 and the autonomous robot 400.

Figure 13:
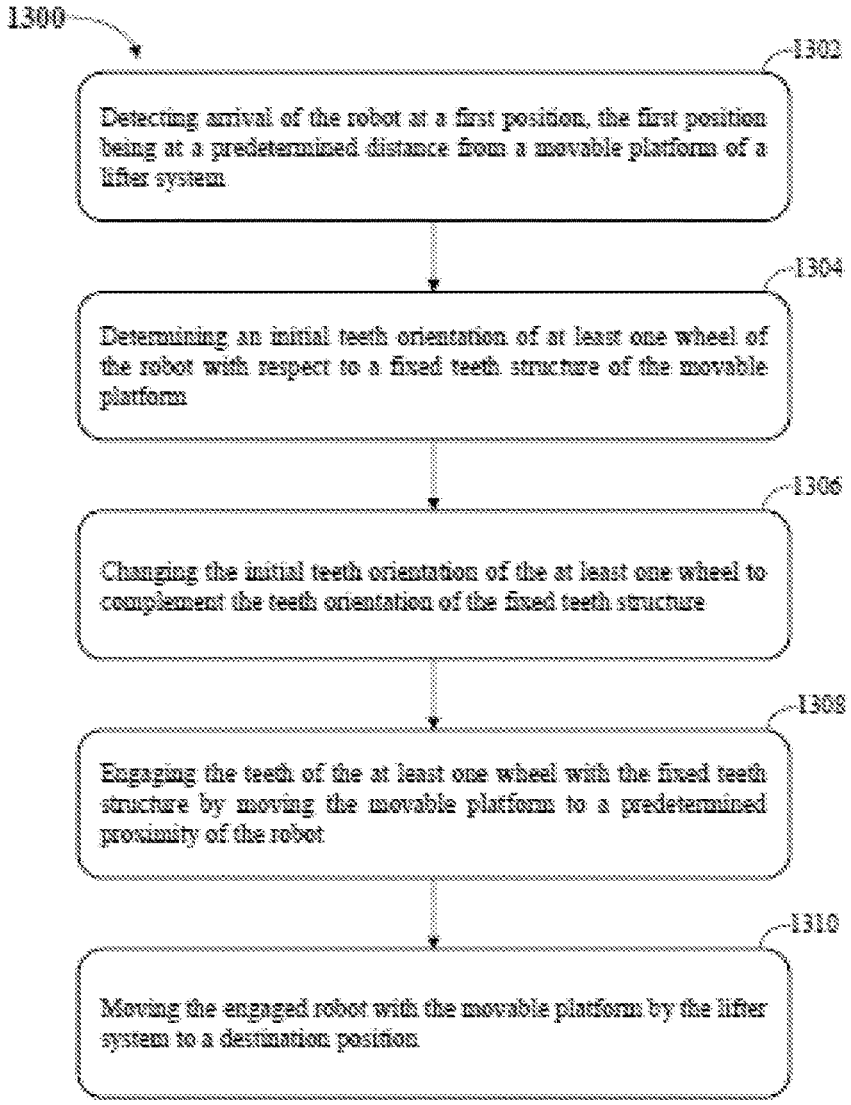
FIG. 13 illustrates a method for traversing mechanism of the robot, according to an embodiment of the present invention.

FIG. 13 illustrates a method 1300 for traversing mechanism of the robot 400, according to an embodiment of the present invention. The method 1300 may include traversal of the robot 400 from a first position to a destination position. In one embodiment, the first position may be a position on a floor and the destination position may be a position on a level 302 of the depository 300. In another embodiment, the first position may be a position on a first level 302*a* of the depository and the destination position may be a position on a different level 302*b* of the depository 300. In yet another embodiment, both the first position and the destination position may be on a same level 302*a* of the depository 300.

At step 1302, arrival of the robot 400 at a first position may be determined. The first position may be at a predetermined distance from the movable platform 106 of the lifter system 100. In one embodiment, the detection of the position of the autonomous robot 400 may be based on at least one of a Global Navigation Satellite System, a Triangulation Network, 2-D Laser mapping, 3-D Laser mapping, Grid Navigation, QR codes, and Cellular Network.

At step 1304, an initial teeth orientation of at least one cog wheel 408 of the robot 400 with respect to the fixed teeth structure 104 of the movable platform 106 may be determined. In one embodiment, the orientation of the teeth 410 of the cog wheels 408 may be determined based on at least one of an image processing, video processing, or encoder based positioning.

At step 1306, the initial orientation of the teeth 410 of the at least one cog wheel may be changed to complement orientation of the teeth 1102 of the fixed teeth structure 104. In one embodiment, the central processing system instructs the autonomous robot 400 to change the orientation of the teeth 410. In another embodiment, the autonomous robot may be pre-programmed to change orientation of the teeth 410 after reaching a predetermined location. In one embodiment, the predetermined location may be between the linear members 104*a* and 104*b* of the fixed teeth structure 104. In this position, the cog wheels 408 are directly above the fixed teeth structure 104 and the floor wheels 412 are in contact of the floor. In one embodiment, changing the teeth orientation comprises rotating the at least one cog wheel 408 by a predetermined angle. In one embodiment, different cog wheels 408 may be rotated by different angles and in different directions, i.e., one cog wheel 408 may be rotated by a first angle in clockwise direction, while another cog wheel 408 may be rotated by a second angle in anti-clockwise direction.

At step 1308, the movable platform 106 may be moved by the lifter system 100 to a predetermined proximity of the robot 400, thereby engaging the teeth 410 of the at least one cog wheel 408 with the teeth 1102 of the fixed teeth structure 104. In one embodiment, the central processing system 1202 may instruct a control unit of the lifter system 100 to move the platform 106. In another embodiment, the control unit of the lifter system 100 may be pre-programmed or hardwired to move the movable platform 106 upon detecting the arrival of the robot 400 at a predetermined position.

At step 1310 the engaged robot 400 may be moved with the movable platform 106 to the destination position by the lifter system 100 to a destination position. In one embodiment, the destination position may be obtained by the control unit of the lifter system 100 from one of the robot 400 or the central processing system 1202.

In an advantageous embodiment, the disclosed methodology according to the present invention provides an improved, cost-effective, simplified and efficient navigation system for the robots 400. Further, neural network based technique, used for automatic navigation for item retrieval and deposition, can be utilized in general for synthesizing any electronic circuit or system with definite functionality whose electrical behavior/characteristics can be modelled in terms of some input and output parameters which are used for subsequently training said neural network.

The present disclosure is applicable to all types of on-chip and off chip memories used in various in digital electronic circuitry, or in hardware, firmware, or in computer hardware, firmware, software, or in combination thereof. Apparatus of the invention can be implemented in a computer program product tangibly embodied in a machine-readable storage device for execution by a programmable processor; and methods actions can be performed by a programmable processor executing a program of instructions to perform functions of the invention by operating on input data and generating output. The invention can be implemented advantageously on a programmable system including at least one input device, and at least one output device. Each computer program can be implemented in a high-level procedural or object-oriented programming language or in assembly or machine language, if desired; and in any case, the language can be a compiled or interpreted language.

Suitable processors include, by way of example, both general and specific microprocessors. Generally, a processor will receive instructions and data from a read-only memory and/or a random access memory. Generally, a computer will include one or more mass storage devices for storing data file; such devices include magnetic disks and cards, such as internal hard disks, and removable disks and cards; magneto-optical disks; and optical disks. Storage devices suitable for tangibly embodying computer program instructions and data include all forms of volatile and non-volatile memory, including by way of example semiconductor memory devices, such as EPROM, EEPROM, and flash memory devices; magnetic disks such as internal hard disks and removable disks; magneto-optical disks; CD-ROM and DVD-ROM disks; and buffer circuits such as latches and/or flip flops. Any of the foregoing can be supplemented by, or incorporated in ASICs (application-specific integrated circuits), FPGAs (field-programmable gate arrays) and/or DSPs (digital signal processors).

It will be apparent to those having ordinary skill in this art that various modifications and variations may be made to the embodiments disclosed herein, consistent with the present disclosure, without departing from the spirit and scope of the present disclosure. Other embodiments consistent with the present disclosure will become apparent from consideration of the specification and the practice of the description disclosed herein.

We claim:

1. A method of traversing for a robot, the method comprising:

detecting arrival of the robot at a first position, the first position being at a predetermined distance from a movable platform of a lifter system;

determining an initial teeth orientation of at least one cog wheel of the robot with respect to a fixed teeth structure of the movable platform;

changing the initial teeth orientation of the at least one cog wheel to complement the teeth orientation of the fixed teeth structure;

engaging the teeth of the at least one cog wheel with teeth of the fixed teeth structure by moving the movable platform to a predetermined proximity of the robot; and moving the engaged robot with the movable platform by the lifter system to a destination position.

2. The method as claimed in claim 1, wherein the first position comprises a position on a floor and the destination position comprises a position in a depository.

3. The method as claimed in claim 1, wherein the detecting comprises detection of the position of the robot based on at least one of a Global Navigation Satellite System, a Triangulation Network, 2-D Laser mapping, 3-D Laser mapping, Grid Navigation, QR codes, and Cellular Network.

4. The method as claimed in claim 1, wherein the teeth orientation is determined based on at least one of an image processing, video processing, encoder based positioning system for the at least one cog wheel.

5. The method as claimed in claim 1, wherein changing the teeth orientation comprises rotating the at least one cog wheel by a predetermined angle.

6. The method as claimed in claim 1, wherein the movable platform is moved based on one of an electric motor mechanism, a magnetic effect based mechanism, and gravitational force based mechanism.

7. A system for traversing of an autonomous robot from a first position to a second position, the system comprising:

a wheel based autonomous robot comprising a plurality of floor wheels and a plurality of cog wheels, wherein the plurality of floor wheels are engaged when the autonomous robot traverses a planar floor surface;

a lifter system comprising a movable platform, the movable platform comprising a fixed teeth structure complementing teeth of the plurality of cog wheels;

a central processing system for:

tracking the autonomous robot;

controlling the lifter system based on a position of the autonomous robot;

determining a teeth orientation of the plurality of cog wheels of the autonomous robot; and changing the teeth orientation of the plurality of cog wheels based on a distance between the movable platform and the autonomous robot.

8. The system as claimed in claim 7, wherein the central processing system comprises a processor coupled to a memory, the processor executing instructions stored in the memory, wherein the stored instructions may be pre-stored or dynamically generated based on an interaction among the central processing system, the lifter system, and the autonomous robot.

9. The system as claimed in claim 7, wherein the autonomous robot comprises:

a processing unit coupled to a memory, the processing unit executing instructions stored in the memory to communicate with a control unit, the control unit configured to control various functions and configurations of the autonomous robot;

a plurality of sensors to sense external environmental conditions and internal configuration of the autonomous robot;

a transceiver configured to exchange data signals with the lifter system and the central processing system based on the external environmental conditions and the internal configuration.

10. The system as claimed in claim 9, wherein the control unit of the autonomous robot is configured to:

disengage the plurality of floor wheels;

determine a relative orientation of teeth of the plurality of cog wheels; and change the relative orientation to a desired relative orientation based on at least a distance between the movable platform and the autonomous robot.

* * * * *